US007994988B2

(12) United States Patent
Wu et al.

(10) Patent No.: US 7,994,988 B2
(45) Date of Patent: Aug. 9, 2011

(54) DUAL-BAND ANTENNA

(75) Inventors: Hsin-Tsung Wu, Tu-Cheng (TW); Kai Shih, Tu-Cheng (TW); Yu-Yuan Wu, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 380 days.

(21) Appl. No.: 12/267,930

(22) Filed: Nov. 10, 2008

(65) Prior Publication Data

US 2010/0117918 A1 May 13, 2010

(51) Int. Cl.
*H01Q 1/24* (2006.01)

(52) U.S. Cl. ..... 343/702; 343/700 MS; 343/846

(58) Field of Classification Search ..... 343/845, 343/700 MS, 702, 770, 846, 860
See application file for complete search history.

(56) References Cited

U.S. PATENT DOCUMENTS 7,839,342 B2 * 11/2010 Su et al. ..... 343/702
2005/0134509 A1 * 6/2005 Lin ..... 343/702
2007/0247372 A1 * 10/2007 Huang ..... 343/700 MS

OTHER PUBLICATIONS

Colin, Robert E., Foundations for Microwave Engineering, 2001, Wiley-IEEE Press, 2nd Edition, p. 73.*

* cited by examiner

*Primary Examiner* — Jacob Y Choi
*Assistant Examiner* — Shawn Buchanan
(74) *Attorney, Agent, or Firm* — Muncy, Geissler, Olds, & Lowe, PLLC

(57) ABSTRACT

A dual-band antenna adapted for an Ultra-mobile Personal Computer has a grounding element including a first grounding portion of elongated plate shape and a second grounding portion extending substantially perpendicular to the first grounding portion from a long edge of the first grounding portion. A connecting element is connected with the second grounding portion. An installing element is connected with the second grounding portion and spaced away from the connecting portion. A radiating element includes a low frequency resonator extending from the connecting element, a high frequency resonator extending opposite to the low frequency resonator and towards the installing element from the connecting element, and an enhancing frequency resonator extending from an edge of the installing element back to the high frequency resonator. The low, high and enhancing frequency resonators are substantially aligned with each other and parallel to the second grounding portion.

5 Claims, 4 Drawing Sheets

| | | |
|---|---|---|
| Mark1 | 2.412GHz | 1.1276 |
| Mark2 | 2.462GHz | 1.4235 |
| Mark3 | 4.900GHz | 1.5469 |
| Mark4 | 5.900GHz | 1.3973 |

| | | | | |
|---|---|---|---|---|
| 1 | 2.412GHz | 55.920Ω | 1.0332Ω | 68.178pH |
| 2 | 2.462GHz | 48.785Ω | 16.879Ω | 1.0912nH |
| 3 | 4.900GHz | 43.934Ω | −19.258Ω | 1.6866pF |
| 4 | 5.900GHz | 35.583Ω | −571.66mΩ | 47.188pF |

| WIFI | | 2412 | 2437 | 2462 | 4900 | 5150 | 5350 | 5470 | 5725 | 5875 |
|---|---|---|---|---|---|---|---|---|---|---|
| Value | Tot.Rad.Pwr. (dBm) | −3.08 | −3.15 | −3.27 | −5.36 | −4.15 | −4.08 | −3.60 | −4.78 | −4.41 |
| | Peak EIRP (dBm) | 0.80 | 0.66 | 0.12 | −0.89 | −0.66 | −0.34 | 0.40 | −0.54 | −1.16 |
| | % | 49.18 | 48.39 | 47.10 | 29.12 | 38.42 | 39.05 | 43.65 | 33.29 | 36.22 |
| | Avg (%) | 48.22 | | | 36.63 | | | | | |

FIG. 4

DUAL-BAND ANTENNA

BACKGROUND OF THE INVENTION

1. Field of the Invention

The present invention relates to a dual-band antenna, and more specifically to a dual-band antenna mainly applied to Ultra-mobile Personal Computer (UMPC).

2. The Related Art

With the development of wireless communication, more and more portable electronic devices, such as notebook computers, are installed an antenna system for working in a wireless local area network (LAN). Because transmitting and receiving signal plays an important role in wireless communication process, an antenna is always required to be improved for better performance. Meanwhile, the portable electronic devices tend to develop towards the direction of miniaturization and multifunction for meeting user's demand, such as UMPC. Accordingly, the antenna is also required to have compact structure to reduce occupied space of the portable electronic device.

SUMMARY OF THE INVENTION

An object of the invention is to provide a dual-band antenna which occupies a small space and has a good performance. The dual-band antenna adapted for an Ultra-mobile Personal Computer has a grounding element including a first grounding portion of elongated plate shape and a second grounding portion extending substantially perpendicular to the first grounding portion from a long edge of the first grounding portion. A connecting element is connected with the second grounding portion. An installing element is connected with the second grounding portion and spaced away from the connecting portion. A radiating element includes a low frequency resonator extending from the connecting element, a high frequency resonator extending opposite to the low frequency resonator and towards the installing element from the connecting element, and an enhancing frequency resonator extending from an edge of the installing element back to the high frequency resonator. The low, high and enhancing frequency resonators are substantially aligned with each other and parallel to the second grounding portion.

As described above, the low frequency resonator, the high frequency resonator and the enhancing frequency resonator are aligned with each other and parallel to the second grounding portion, such structure is compact and can be manufactured easily, only occupies a small space when the dual-band antenna is mounted in the UMPC. Furthermore, the dual-band antenna has the enhancing frequency resonator enhancing resonance of the high frequency resonator, which increases the efficiency of the dual-band antenna so that the dual-band antenna can achieve a good performance of operation.

BRIEF DESCRIPTION OF THE DRAWINGS

The invention, together with its objects and the advantages thereof may be best understood by reference to the following description taken in conjunction with the accompanying drawings, in which:

FIG. 4 is a schematic diagram illustrating Total Radiated Power (TRP) of the dual-band antenna shown in FIG. 1, wherein the value of Peak Effective Isotropic Radiated Power (PEIRP) is also shown.

DETAILED DESCRIPTION OF THE EMBODIMENT

Figure 1:
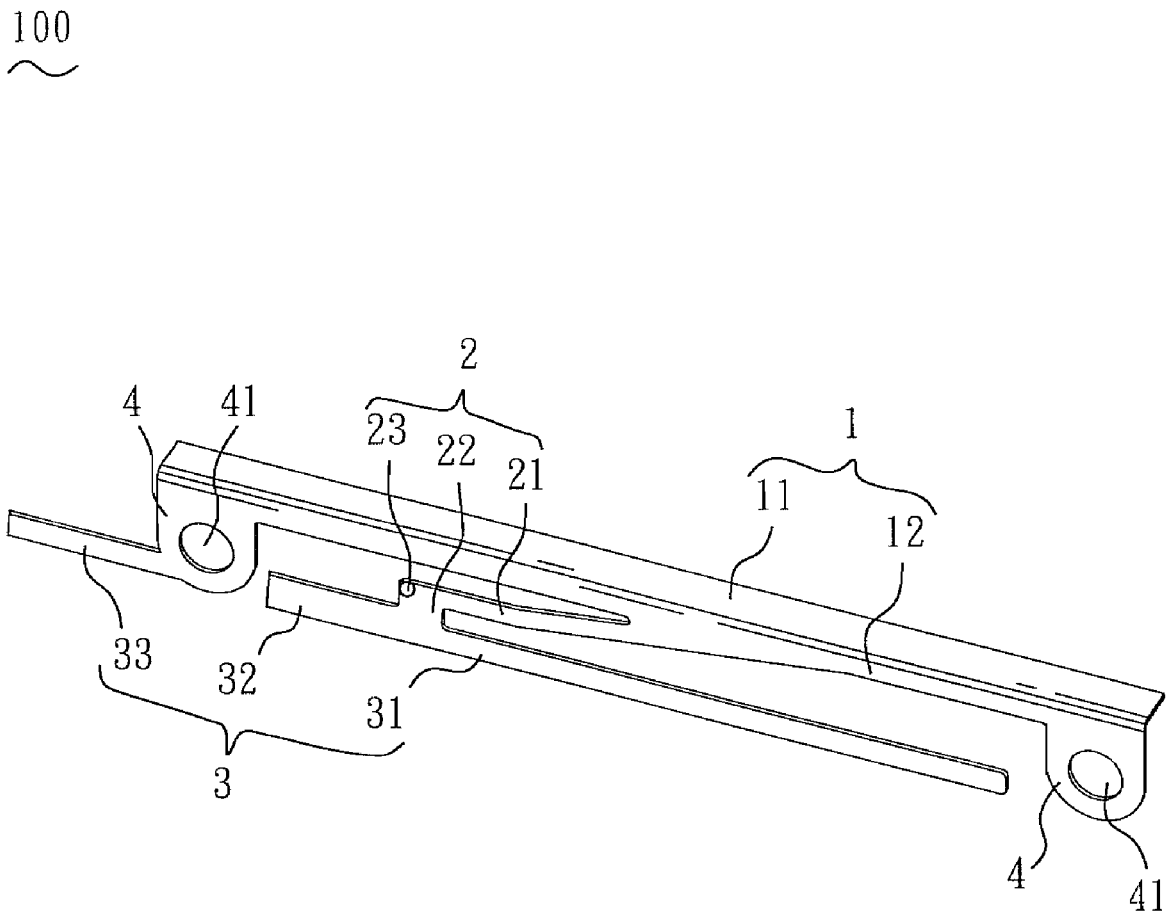
FIG. 1 is a perspective view illustrating the structure of a dual-band antenna of an embodiment in accordance with the present invention.

Referring to FIG. 1, an embodiment of a dual-band antenna 100 according to the present invention is shown. The dual-band antenna 100 made of a metal patch includes a grounding element 1, a connecting element 2, a radiating element 3 and a pair of installing elements 4.

The grounding element 1 includes a first grounding portion 11 and a second grounding portion 12 intersecting with the first grounding portion 11. The first grounding portion 11 is an elongated shape and disposed levelly. The second grounding portion 12 extends substantially perpendicular to the first grounding portion 11 from a long edge of the first grounding portion 11 and is also an elongated shape. The installing elements 4 are extended downwardly from two ends of a lower edge of the second grounding portion 12 opposite to the first grounding portion 11. An installing hole 41 is formed on the installing element 4 for fixing the dual-band antenna 100 to an Ultra-mobile Personal Computer (UMPC) (not shown).

The connecting element 2 coplanar with the second grounding portion 12 includes a first connecting portion 21 and a second connecting portion 22. The first connecting portion 21 is extended obliquely and downwardly from a substantial middle of the lower edge of the second grounding portion 12. The first connecting portion 21 and the second grounding portion 12 constitute cooperatively an analogue inductor. The first connecting portion 21 also may be extended perpendicularly from the second grounding portion 12 and then bent to be parallel to the second grounding portion 12. A free end of the first connecting portion 21 extends towards one of the installing elements 4 and downwardly with a short distance to form the second connecting portion 22. The second connecting portion 22 is a rectangular shape and defines a feeding point 23 at a corner thereof adjacent to the second grounding portion 12 and away from the first connecting portion 21.

The radiating element 3 is coplanar with the connecting element 2 and includes a low frequency resonator 31, a high frequency resonator 32 flush with the low frequency resonator 31, and an enhancing frequency resonator 33. The low frequency resonator 31 extends from a side of the second connecting portion 22 adjacent to the first connecting portion 21 to show an elongated shape. The high radiating resonator 32 extends from an opposite side of the second connecting portion 22 to form an elongated shape, and is shorter than the low frequency resonator 31 in length. The enhancing frequency resonator 33 is disposed to be flush with the low and high frequency resonator 31, 32, and extends from the corresponding installing element 4 adjacent to the high frequency resonator 32. Especially, the enhancing frequency resonator 33 extends from an edge of the corresponding installing element 4 away from the high frequency resonator 32. The length of the enhancing frequency resonator 33 is substantially same as that of the high frequency resonator 32. In this case, the low, high and enhancing frequency resonator 31, 32 and 33 are substantially flush with a bottom edge of the installing element 4 and parallel to the second grounding portion 12.

When the dual-band antenna 100 operates at wireless communication, the current is fed from the feeding point 23 to the low frequency resonator 31 to generate an electrical resonance corresponding to a quarter wavelength of 2.4 GHz frequency band. The current is fed from the feeding point 23 to the high frequency resonator 32 to cause an electrical resonance corresponding to a quarter wavelength of 5.2 GHz frequency band. Because the enhancing frequency resonator 33 has the same wavelength as the high frequency resonator 32, the enhancing frequency resonator 33 can also receive electromagnetic signal within 5.2 GHz frequency band, which will enhance resonance of the high frequency resonator 32 so as to improve the effect of the dual-band antenna 100.

Figure 2:
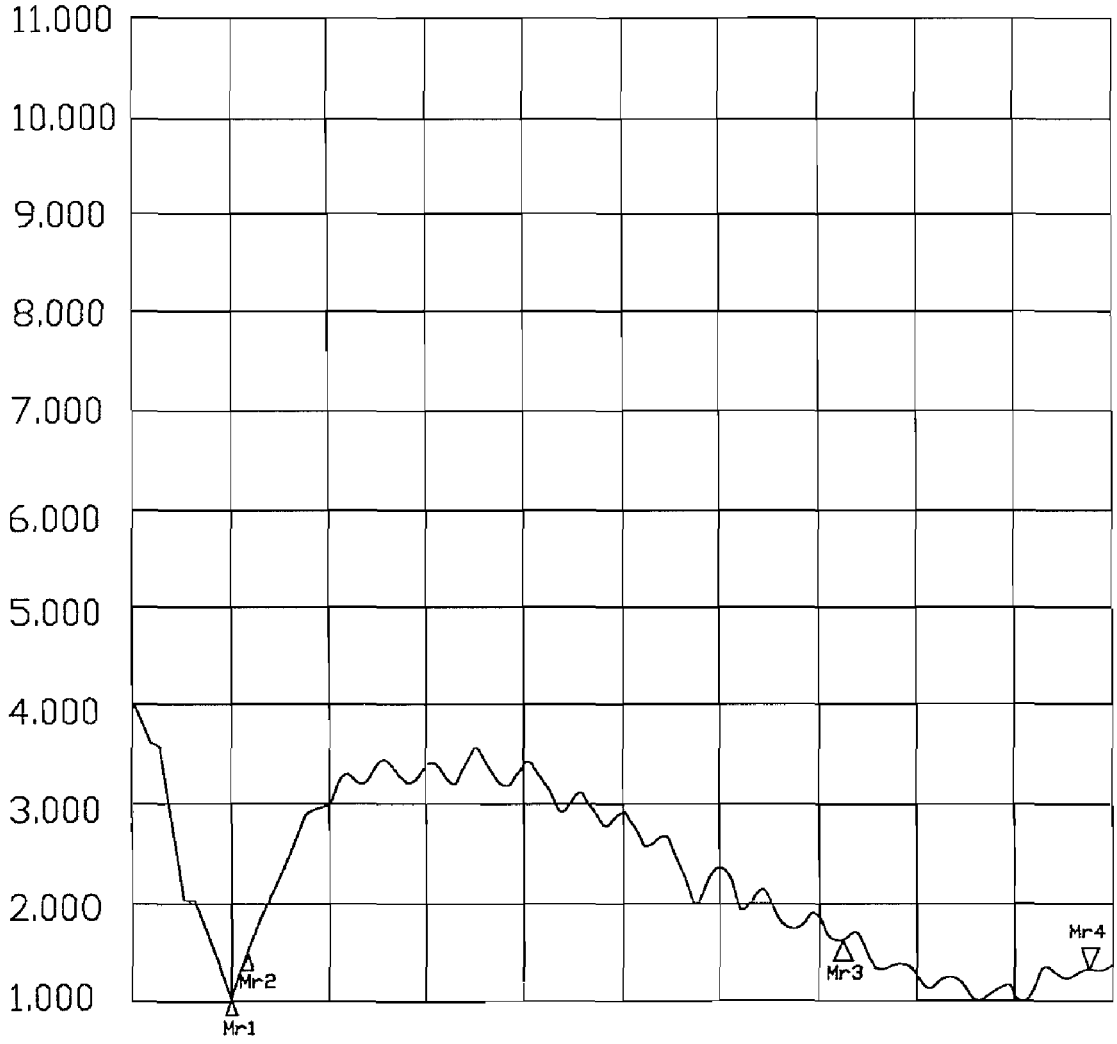
FIG. 2 shows a Voltage Standing Wave Ratio (VSWR) test chart of the dual-band antenna shown in FIG. 1.

FIG. 2 shows a Voltage Standing Wave Ratio (VSWR) test chart of the dual-band antenna 100 when the dual-band antenna 100 operates at wireless communication. When the dual-band antenna 100 operates at a frequency of 2.412 GHz (indicator Mr1 in FIG. 2), the resulting VSWR value is 1.1276. When the dual-band antenna 100 operates at a frequency of 2.462 GHz (indicator Mr2 in FIG. 2), the resulting VSWR value is 1.4235. When the dual-band antenna 100 operates at a frequency of 4.900 GHz (indicator Mr3 in FIG. 2), the resulting VSWR value is 1.5469. When the dual-band antenna 100 operates at a frequency of 5.900 GHz (indicator Mr4 in FIG. 2), the resulting VSWR value is 1.3973. Consequently, the VSWR values of the dual-band antenna 100 are all less than 2, which means that the dual-band antenna 100 has an excellent frequency response between 2.412 GHz and 2.462 GHz, and between 4.900 GHz and 5.900 GHz as well.

Figure 3:
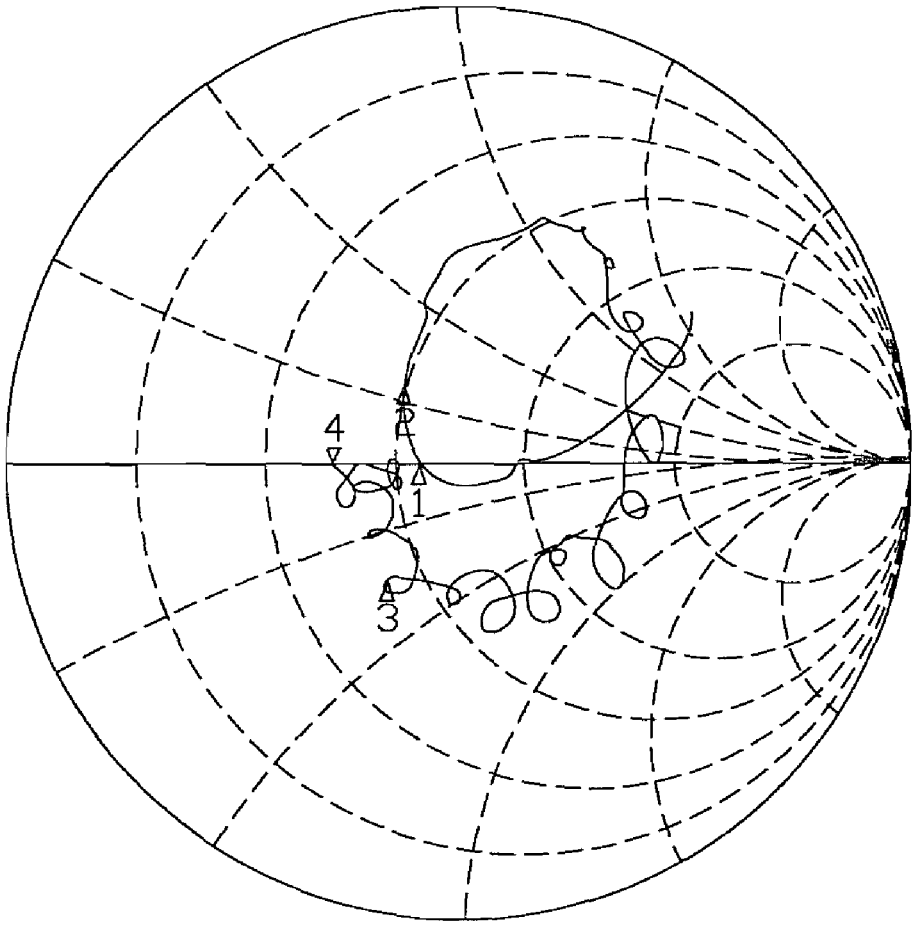
FIG. 3 is a Smith chart recording impedance of the dual-band antenna shown in FIG. 1.

Please refer to FIG. 3, which shows a Smith chart recording impedance of the dual-band antenna 100 when the dual-band antenna 100 operates at wireless communication. The dual-band antenna 100 exhibits an impedance of (55.920+j1.0332) Ohm at 2.412 GHz (indicator 1 in FIG. 3), an impedance of (48.785+j16.879) Ohm at 2.462 GHz (indicator 2 in FIG. 3), an impedance of (43.934−j19.258) Ohm at 4.900 GHz (indicator 3 in FIG. 3) and an impedance of (35.583−j0.57166) Ohm at 5.900 GHz (indicator 4 in FIG. 3). Therefore, the dual-band antenna 100 has good impedance characteristic.

Referring to FIG. 4, which shows the Total Radiated Power for the dual-band antenna 100. When the dual-band antenna 100 operates at the frequency band ranging between 2.412 GHz and 2.462 GHz, the efficiency is between 47.10 percent and 49.18 percent, and the average efficiency is 48.22 percent. When the dual-band antenna 100 operates at the frequency band covering between 4.9 GHz and 5.875 GHz, the efficiency is between 29.12 percent and 43.65 percent, and the average efficiency is 36.63 percent.

As described above, the low, high and enhancing frequency resonator 31, 32 and 33 are parallel to the second grounding portion 12 and substantially flush with the bottom edge of the installing element 4, such structure is compact and can be manufactured easily, and only occupies a small space when the dual-band antenna 100 is mounted in the UMPC. Furthermore, the dual-band antenna 100 has the enhancing frequency resonator 33 enhancing resonance of the high frequency resonator 32, which increases the efficiency of the dual-band antenna 100, so that the dual-band antenna 100 can achieve a good performance of operation.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A dual-band antenna adapted for an ultra-mobile personal computer, comprising:

a grounding element including a first grounding portion of elongated plate shape and a second grounding portion extending substantially perpendicular to the first grounding portion from a long edge of the first grounding portion;

a connecting element connected with the second grounding portion;

an installing element connected with the second grounding portion and spaced away from the connecting portion; and a radiating element including a low frequency resonator extending from the connecting element, a high frequency resonator extending opposite to the low frequency resonator and towards the installing element from the connecting element, and an enhancing frequency resonator extending from an edge of the installing element away from the high frequency resonator, the low frequency resonator, the high frequency resonator and the enhancing frequency resonator being substantially aligned with each other and parallel to the second grounding portion.

2. The dual-band antenna as claimed in claim 1, wherein the low frequency resonator is adapted for operating at 2.4 GHz frequency band, the high frequency resonator is adapted for operating at 5.2 GHz frequency band, and the enhancing frequency resonator is adapted for enhancing resonance of the high frequency resonator.

3. The dual-band antenna as claimed in claim 1, wherein the connecting element includes a first connecting portion extending obliquely and downwardly from a lower edge of the second grounding portion opposite to the first grounding portion, and a second connecting portion extending towards the installing element and downwardly from a free end of the first connecting portion, the first connecting portion and the second grounding portion form cooperatively an analogue inductor.

4. The dual-band antenna as claimed in claim 3, wherein the low frequency resonator is extended from a side of the second connecting portion, while the high frequency resonator is extended from an opposite side of the second connecting portion.

5. The dual-band antenna as claimed in claim 1, wherein two installing elements extend downwardly from two ends of a lower edge of the second grounding portion opposite to the first grounding portion, each of the two installing elements has an installing hole thereon for fixing the dual-band antenna to the ultra-mobile personal computer.

* * * * *